US007814837B2

(12) United States Patent
Sauvestre

(10) Patent No.: US 7,814,837 B2
(45) Date of Patent: Oct. 19, 2010

(54) HUNTING BULLET WITH REDUCED AERODYNAMIC RESISTANCE

(76) Inventor: Jean-Claude Sauvestre, 64, rue de la Vallée, Saint-Doulchard (FR) F-18230

( * ) Notice: Subject to any disclaimer, the term of this patent is extended or adjusted under 35 U.S.C. 154(b) by 0 days.

(21) Appl. No.: 10/571,591

(22) PCT Filed: Sep. 9, 2004

(86) PCT No.: PCT/FR2004/002289

§ 371 (c)(1),
(2), (4) Date: Mar. 10, 2006

(87) PCT Pub. No.: WO2005/026653

PCT Pub. Date: Mar. 24, 2005

(65) Prior Publication Data

US 2007/0028793 A1 Feb. 8, 2007

(30) Foreign Application Priority Data

Sep. 10, 2003 (FR) ..... 03 10655

(51) Int. Cl.
*F42B 12/34* (2006.01)

(52) U.S. Cl. ..... 102/508; 102/518

(58) Field of Classification Search ..... 102/503, 102/507, 508, 509, 510, 517, 518, 519; D22/116
See application file for complete search history.

(56) References Cited

U.S. PATENT DOCUMENTS 1,076,419 A * 10/1913 Hadfield et al. ..... 102/519
1,077,607 A * 11/1913 Johnson et al. ..... 102/507
1,080,976 A * 12/1913 Johnson et al. ..... 102/507
1,080,977 A * 12/1913 Johnson et al. ..... 102/507
1,096,558 A * 5/1914 Newton et al. ..... 102/508
1,709,414 A 4/1929 Stendebach
4,136,616 A * 1/1979 Schirneker ..... 102/510
4,685,397 A * 8/1987 Schirneker ..... 102/510

(Continued)

FOREIGN PATENT DOCUMENTS

CH 625043 8/1981

(Continued)

OTHER PUBLICATIONS

Bibliographic data sheet for WIPO case WO/2001/020245 (abstract).*

(Continued)

*Primary Examiner*—Benjamin P Lee
(74) *Attorney, Agent, or Firm*—Merchant & Gould PC

(57) ABSTRACT

The invention relates to ammunition for hunting guns.

The bullet is of the type comprising an internal shaft (4) with a rigidity equal to or greater than that of the body of the bullet, disposed in a hole drilled in the body of the bullet along its axis, and this internal shaft (4) is set back from the orifice (8) of the hole, the latter, situated on the axis, has a smaller diameter than that of the internal shaft (4), and the wall of the ogival head (3) of the bullet body (2) comprises one or more deformation notches close to the orifice of the hole.

Applicable to the improvement of the terminal efficiency of small, medium or large caliber hunting guns with the caliber of the gun or undersizes.

15 Claims, 3 Drawing Sheets

U.S. PATENT DOCUMENTS

| | | | | |
|---|---|---|---|---|
| 4,756,254 | A * | 7/1988 | Bai et al. | 102/511 |
| 4,776,279 | A * | 10/1988 | Pejsa | 102/510 |
| 4,911,080 | A * | 3/1990 | Leeker et al. | 102/529 |
| 4,961,382 | A * | 10/1990 | Bai et al. | 102/476 |
| 5,097,768 | A | 3/1992 | Petrovich | |
| 5,804,759 | A * | 9/1998 | Sauvestre | 102/439 |
| 6,363,856 | B1 * | 4/2002 | Stoker et al. | 102/516 |
| 6,837,165 | B2 * | 1/2005 | Eberhart et al. | 102/510 |
| 6,845,717 | B1 * | 1/2005 | Sauvestre | 102/518 |
| 6,971,315 | B2 * | 12/2005 | Knappworst et al. | 102/510 |
| 2004/0129164 | A1 * | 7/2004 | Kellner | 102/507 |

FOREIGN PATENT DOCUMENTS

| | | |
|---|---|---|
| DE | 456738 | 2/1928 |
| DE | 10042719 | 3/2001 |
| DE | 10045009 | 5/2001 |
| WO | 0045120 | 8/2000 |

OTHER PUBLICATIONS

Definition of "smoothly" from www.meriam-webster.com.*
International Search Report dated Jan. 28, 2005.

* cited by examiner

HUNTING BULLET WITH REDUCED AERODYNAMIC RESISTANCE

BACKGROUND OF THE INVENTION

1. Field of the Invention

The present invention relates to ammunition for small, medium and large caliber guns, and more particularly to a new bullet, notably for hunting guns, having a reduced aerodynamic drag and providing an improved terminal efficiency, in particular in a soft target.

2. Description of the Related Art

Ammunition for the most traditional hunting guns are usually sleeved bullets with a lead alloy core, whose front portion comprises an ogive with a flattened or rounded head. According to a variant, certain bullets have a central channel in the ogive. Thus, U.S. Pat. No. 3,881,421 describes a bullet whose head is hollowed out to cause it to flatten on impact with the target. This ammunition usually has the disadvantage of a high velocity loss on the trajectory and a major loss of mass on impact with the target due to a break-up of the bullet.

Also known are bullets of the same type comprising, on the front end of the ogive, a part made of plastic or other materials intended to improve the aerodynamics of the bullet and the accuracy of the shot, as in patent CH 625043. However, these bullets fragment and expand poorly on impact with the target, which impairs their terminal efficiency.

Application WO 0045120 describes a bullet comprising a broadened base metal core, supporting an envelope with an open ogival head protruding from the central core. U.S. Pat. No. 5,259,320 shows an example of a monometallic lead-free bullet, comprising a central channel situated in the ogive, which has fracture notches intended to control the expansion of the head of the cone and its rolling up in petals, on impact with the target. This technique has the disadvantage of a random expansion, and a risk of fragmentation of the petals formed. In addition, the method of manufacture of this type of bullet by cold stamping causes dynamic imbalances which have the effect of a dispersion of the shots.

The technique of shafted bullet ammunition is today well known. This ammunition comprises a sub-projectile (shaft) stabilized by fins, associated with a sabot (or launcher) having the caliber of the gun, and is described for example in patent FR-A-2.555.728. An enhancement made to this technique is described in patent FR-A-2.795.170 relating to a monometallic bullet with the caliber of the gun or undersize, comprising an internal shaft with a rigidity greater than that of the body of the bullet, disposed along its axis. Bullets of this type are extremely accurate and make it possible to regulate the expansion and retain the mass of the bullet on impact with the target. According to this technique, the diameter of the nose of the ogive represents approximately between 40 and 50% of the maximum diameter of the bullet, which provides it with considerable aerodynamic drag. These bullets are therefore mainly intended for "bush-beating" shooting, over short and medium distances, less than 150 m for rifles and of the order of 50 to 60 m for shotguns. Beyond these distances, and mainly with low initial velocity bullets, the velocity on impact with the target is too low to cause a radial expansion of the body of the bullet that is necessary for satisfactory efficiency.

For "close range" or "stalking" shooting, it is essential to reduce the aerodynamic drag of the bullet on its trajectory, without, for all that, reducing its terminal efficiency.

The precise object of the present invention is to optimize the ballistics of a metal lead-free bullet of the above type to obtain the lowest possible aerodynamic drag on the trajectory while retaining an excellent terminal efficiency on the target while preventing losses of mass of the metal body of the bullet at great distances which may be of the order of 300 m.

SUMMARY OF THE INVENTION

The subject of the present invention is therefore a bullet for a small, medium or large caliber gun, with the caliber of the gun or undersize, of the type comprising an internal shaft with a rigidity equal to or greater than that of the body of the bullet, disposed in a hole drilled in the body of the bullet along its axis, wherein the internal shaft is set back from the orifice of the hole, the latter, situated on the axis, has a smaller diameter than that of the internal shaft, and the wall of the ogival head of the bullet body comprises one or more deformation notches close to the orifice of the hole.

According to a preferred embodiment, the deformation notches of the ogival head are made by a narrowing of the ogival head, separating the ogival nose from the rear portion of the ogive.

Thus, the bullet of the invention has, in its front portion, a conical or cylindro-conical shaped cavity, delimited on its large base by the front face of the internal shaft, and opening onto the ogival nose of the bullet via a small orifice, preferably circular, situated in the axis.

The ogive forming the head of the bullet is very streamlined, so as to procure as little as possible aerodynamic drag, and for this purpose, the orifice of the hole enclosing the internal shaft has a smaller diameter than that of the internal shaft, the ratio $d_1/d$ of the diameter $d_1$ of the orifice to the diameter d of the internal shaft lying between 0.1:1 and 0.9:1.

According to an advantageous embodiment of the invention, the nose of the ogive comprises a flat whose external diameter $d_2$ is such that the ratio $d_2/d$ lies between 0.3:1 and 1.5:1. According to a preferred embodiment of the invention, the ratio $d_2/d$ lies between 0.6:1 and 1:1, while the diameter $d_1$ of the orifice is such that the ratio $d_1/d$ lies between approximately 0.3:1 and 0.6:1.

The deformation notches made in the wall of the ogival head are intended to make it easier for the nose of the ogive to deform and open on impact with the target, in order to cause a deformation by "mushrooming".

These deformation notches contribute to the stepped ogival shape of the front portion of the bullet. This ogival shape comprises an ogival nose surrounding the orifice communicating with the conical or cylindro-conical cavity, and a rear portion, which interact to minimize and reduce as much as possible any discontinuity of air flow in flight which could cause Mach wave detachments impairing the aerodynamic drag.

As indicated above, these deformation notches may preferably be made in the shape of a narrowing in the external wall of the ogive, separating the ogival nose, open to the front, from the rear portion of the ogive, so that the cross section of the base of the ogival nose is slightly greater than that of the front of the rear portion of the ogive. This narrowing is preferably situated at the base of the internal conical or cylindro-conical cavity formed in front of the internal shaft, or slightly ahead of this base, and more preferably at the line where the conical and cylindrical surfaces meet when the internal cavity is of the cylindro-conical shape.

The narrowing made in the wall of the ogive to form the deformation notch is materialized by a crank between the base of the ogival nose and the front end of the rear portion of the ogive, and the radial height of this crank, for medium caliber bullets, usually lies between 0.05 and 1 mm, and preferably between 0.1 and 0.5 mm.

The theoretical profile of the ogival nose and of the rear portion of the ogive meet along a tangential line situated at a distance of between ⅕ and ⅘ approximately, preferably between ⅓ and ⅔ approximately, of the height of the rear portion of the ogive. Preferably, the rear portion of the ogive has a convex profile.

According to an advantageous embodiment of the invention, the internal cavity has a cylindro-conical shape, where the cylinder and the cone are coaxial, joining via the large base of the cone, the latter being placed in front of the cylinder. According to a variant, the internal cavity has a dual truncated cone shape, the two cones being joined at their large base, the small base of the rear truncated cone being closed by the internal shaft.

According to another advantageous embodiment, the front of the internal shaft protrudes slightly into the internal cavity formed in the ogival nose, that is to say that the truncated cone-shaped or cylindrical wall of the base of the internal cavity comes into contact with the external surface of the shaft slightly behind the front end of the latter. This has the effect of forming an annular volume that may serve as an expansion notch of the bullet head on impact with the target.

The internal shaft inserted into the body of the metal bullet may be made of one or more elements. When it consists of a single cylindrical element, the latter preferably supports several longitudinal or transverse ribs that improve the connection with the bullet body. The hole drilled in the bullet body, into which the internal shaft is inserted, may be a through or blind hole, and preferably blind.

The bullet according to the present invention has the advantage of substantially reducing the aerodynamic drag on the trajectory, while ensuring control of the deformation of the body of the bullet on impact with the target, even at great distance. Thus, by comparison with a bullet according to patent FR-A-2.795.170 having the same mass and the same dimensions, the coefficient of aerodynamic drag is reduced by approximately half for projectile velocities of the order of Mach 2.

More particularly, the low aerodynamic drag on the trajectory allows the bullet of the invention to retain a high velocity until impact with a target more than 300 m away. Thus, the bullet then deforms in a controlled manner by rolling up about its axis, on impact with the soft portions of the target, and ensures the effective destruction of the hard portions of said target, even at great distances, which may be greater than 300 m in the case of bullets of the caliber.

This result may be obtained, according to the invention, with a metal lead-free bullet, although the volumic mass of the materials usually used as lead substitutes is approximately 20% less than the latter, and the volume of the bullet is substantially identical because of the standards imposed in this technical field. It is known that the highest possible bullet mass is necessary, for a given caliber and a determined aerodynamic drag coefficient, to obtain sufficient energy on impact. The invention therefore makes it possible to offset the consequences of the reduction in the volumic mass of lead-free bullets, and to improve the terminal efficiency of the bullet.

As indicated above, the bullet of the invention is preferably a metal lead-free bullet. The body of the bullet may be made of metal or metal alloy chosen from copper and the copper alloys, and preferably a brass containing 5 to 40% zinc.

The shaft or metal insert in the axis of the bullet may be made of metal or metal alloy chosen from steel, copper and the aluminum or copper alloys, for example a brass.

The bullet of the invention may be manufactured by conventional techniques, for example by first forming a bullet provided with a cylindrical axial hole opening to the front, inserting the internal shaft, and then forming the ogival nose by mechanical cold forming.

The invention applies to hunting gun bullets that are gyrostabilized or stabilized by fins, of the caliber of the gun or undersize, associated with a launch sabot.

The features and advantages of the present invention will appear in greater detail in the following description, relating to preferred embodiments, with reference to the appended drawings, which represent:

DETAILED DESCRIPTION

Figure 1:
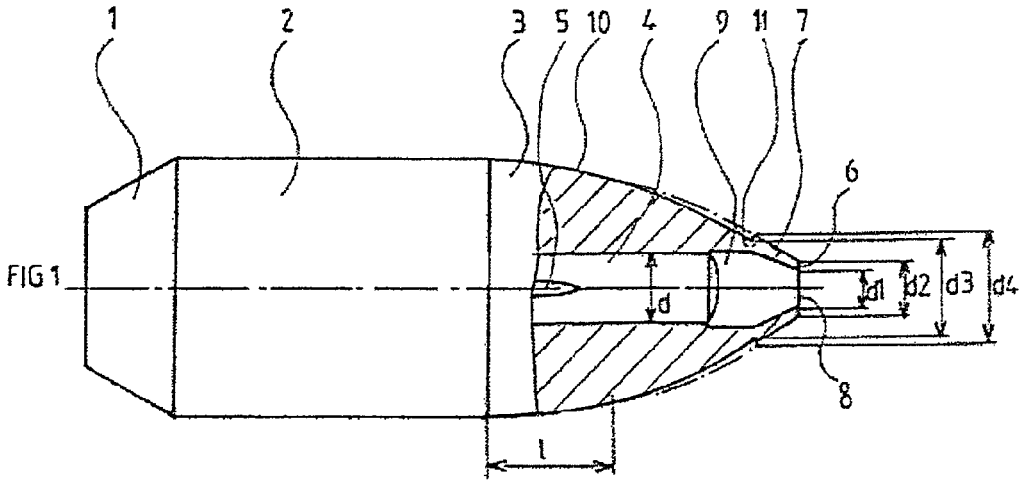
FIG. 1: a schematic view of a gyrostabilized bullet with the caliber of the gun, according to the invention.

As shown in FIG. 1, the bullet with the caliber of the gun is of the monobloc metal type and comprises at its rear portion a basal narrowing (1), at its central portion a body (2), and at its front portion a stepped ogive (3).

An internal supported shaft (4) whose surface supports longitudinal ribs (5) is placed in a hole drilled in the axis of the bullet body and passing through the ogive (3).

The bullet supporting the internal shaft (4) is inserted into a case furnished with a percussion cap and a charge, of conventional type, not shown.

The ogival head (3) of the bullet is very streamlined to reduce aerodynamic drag as much as possible, and the diameters $d_1$ of the orifice (8) and $d_2$ of the flat (6) of the nose (7) that surrounds it are as small as possible. Thus, in the example of FIG. 1, the diameter $d_2$ of the flat is slightly less than the diameter d of the internal shaft (4), the ratio $d_2$:d being close to 0.8:1, while the diameter $d_1$ of the orifice is such that the ratio $d_1$:d is equal to approximately 0.5.

The internal cylindro-conical cavity (9) thus delimited, opens into the nose (7) of the ogive (3) via the circular shaped orifice (8).

The theoretical profile of the nose (7) and the rear portion (10) of the ogive (3) meet on a tangential line situated at a distance (1) of approximately ½ the height of the rear portion (10) of the ogive from the connection of the latter with the central portion (2) of the bullet.

The large base of the nose of the stepped ogive (3) has a diameter $d_4$ slightly greater than the front diameter d3 of the rear portion of the ogive. This arrangement, in relation to the shape of the internal cavity (9) causes a thinning of the wall of the ogival head, thus generating a line of mechanical weakness (11). This line of weakness (11) makes it possible to control the deformation of the ogival head (3) on impact with the target.

Figure 2:
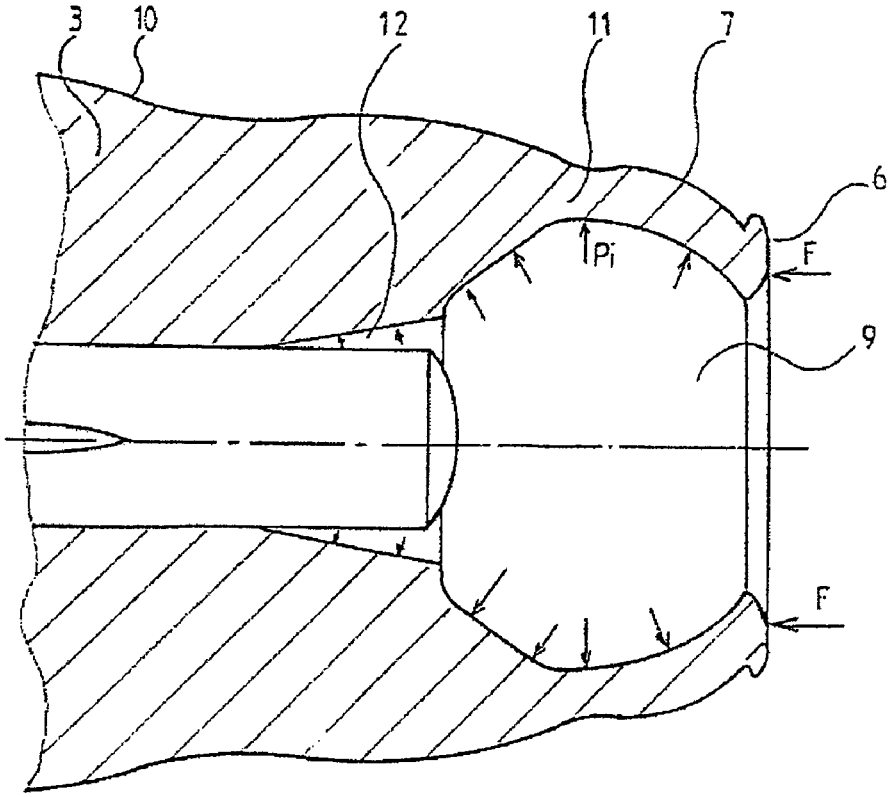
FIG. 2: a partial view in section of the front portion of the ogive of the bullet of FIG. 1, showing the beginning of deformation on impact with the target.

FIG. 2 shows the beginning of the deformation of the stepped ogive (3) on impact with the target. The force (F) is exerted on the base of the flat (6) of the nose (7) of the stepped ogive (3) of the bullet. Thus, the nose (7) crumples progressively while causing a radial expansion of the wall of the nose, whose point of articulation is situated at right angles to the line of mechanical weakness (11). This movement causes the deformation by radial expansion of the front of the portion (10) of the ogive (3), causing the formation of a conical entrance (12) which then generates the "mushrooming" of the bullet.

At the same time, the soft portions of the target are engaged in the cavity (9) and in the conical entrance (12), and they thus create a considerable radial pressure Pi on the internal walls of the cavity (9). This pressure, combined with the line of mechanical weakness (11) contributes to the initiation of the process of "mushrooming" or of expansion of the bullet.

Figure 3:
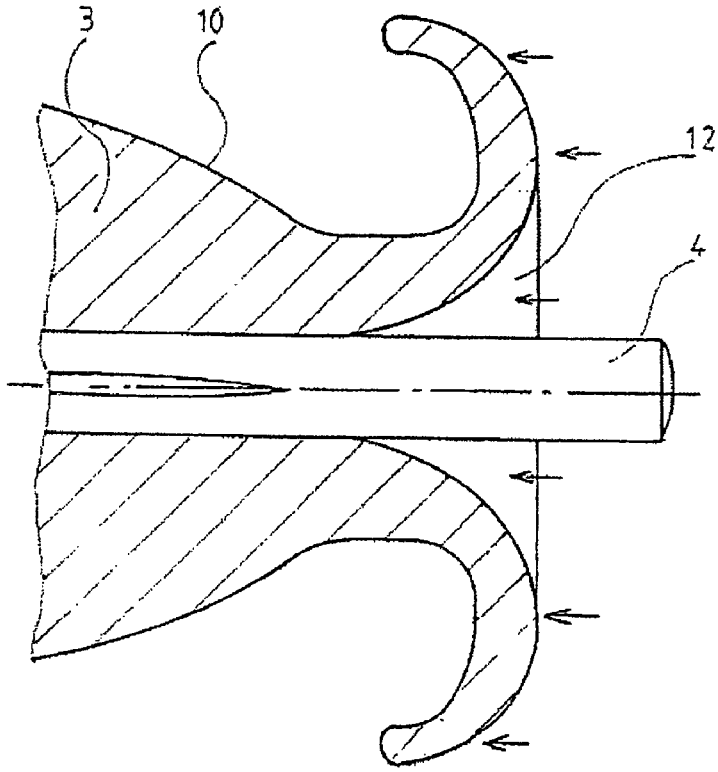
FIG. 3: a partial view in section of the front portion of the ogive, at the beginning of penetration into the target after impact.

FIG. 3 shows the evolution of the process of "mushrooming" of the bullet. The conical entrance (12) continues to open, while the ogival head (3) of the bullet rolls up about the axis of the bullet, uncovering the front point of the internal shaft (4) whose rigidity is greater than that of the body of the bullet. When the "mushrooming" process has reached its end phase, the wall of the ogival head of the bullet is totally inside out and the body of the bullet then has a mushroom shape without loss of material, while the internal shaft may, where necessary, be detached. The diameter of the bullet body thus deformed is approximately three times the initial diameter.

Figure 4:
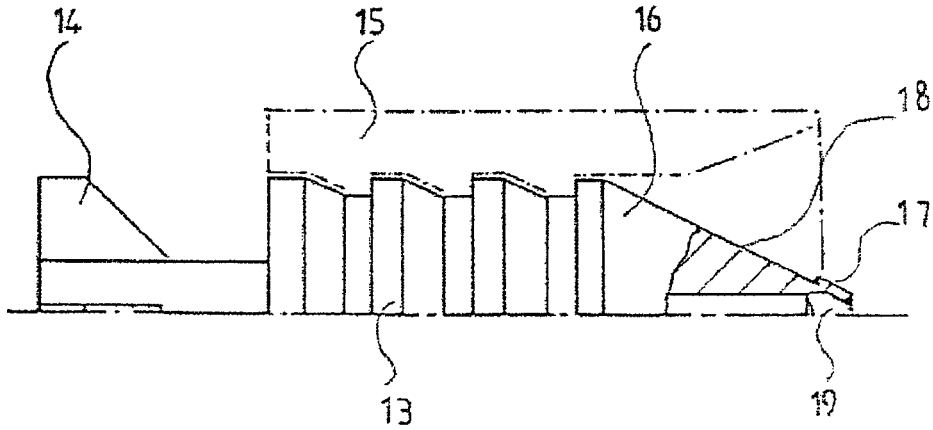
FIG. 4: a schematic half-view in partial section of a variant embodiment of the invention, representing an undersize bullet.

FIG. 4 represents the invention applied to an undersize bullet (13) supporting a fin (14) on its rear portion, housed in a launch sabot (15), the assembly being placed, in the usual manner, in a primed and charged cartridge case, not shown.

As shown in FIG. 4, the stepped ogive (16) comprises a nose (17) whose large base has a diameter (identical to the diameter $d_4$ of FIG. 1) greater than the diameter of the front of the rear portion (18) of the ogive (16) (identical to the diameter $d_3$ of FIG. 1). The internal cavity (19) is substantially identical to the internal cavity (9) of the bullet of FIG. 1, and operates in the same manner on impact with the target.

This undersize bullet may be used in a shotgun with a smooth or slightly rifled barrel for shooting distances not usually exceeding 100 meters. This bullet is stabilized on the trajectory by the fin (14).

Figure 5:
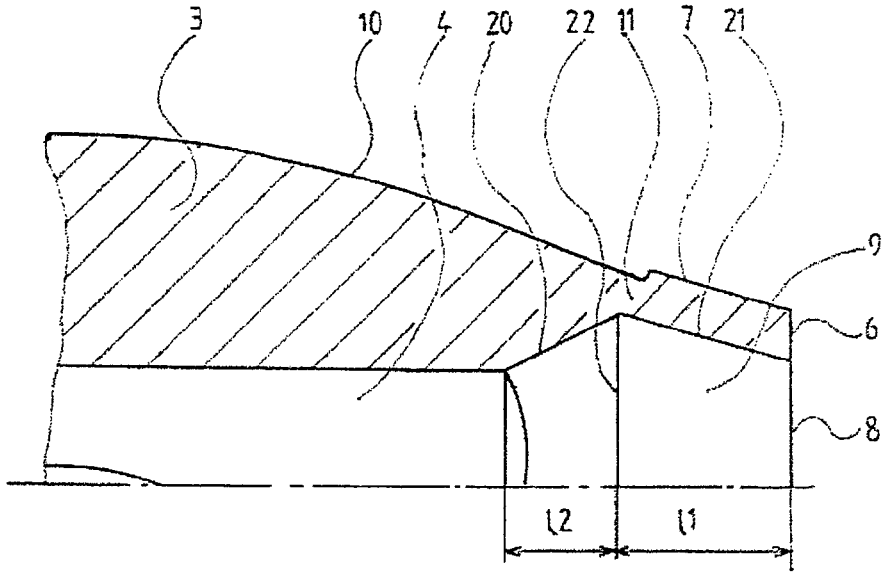
FIG. 5: a partial half-view in section of a variant of the internal cavity of the ogive of the bullet of FIG. 1.

A variant embodiment of the ogival nose of the bullet is shown in FIG. 5.

As this figure shows, the internal cavity (9) consists of two trunks of cones joining at their large base, so that the truncated cone surface (20) of the rear portion and the truncated cone surface (21) of the front portion meet on a line situated immediately next to the narrowing at the base of the ogival nose.

In this embodiment, the distance 11 between the plane of the orifice (8) and the line (22) where the two truncated cone surfaces (20) and (21) meet is equal to approximately 1.5 times the distance 12 separating this same line of the plane from the line where the truncated cone surface (20) and the surface of the internal shaft (4) meet.

According to a variant (not shown), the truncated cone surface (20) meets the external surface of the internal shaft (4) slightly behind the front end of the latter. According to another variant, the junction (22) between the two truncated cone surfaces (20) and (21) occurs on a rounded surface or else, the truncated cone surface (20) is replaced by a spherical ring surface connecting without interruption to the truncated cone surface (21).

Figure 6:
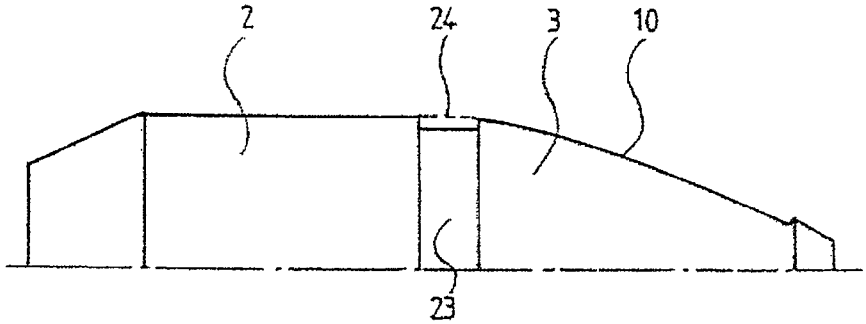
FIG. 6: an external half-view of the bullet of FIG. 1 comprising a crimping groove where the ogive and the central portion of the bullet meet.

FIG. 6 shows, in an external half-view, a variant of the bullet of FIG. 1, comprising a crimping groove (23) situated on the theoretical connection (24) of the rear portion (10) of the ogival head with the body (2) of the bullet. This rear portion (10) of the ogive has a convex profile.

The crimping groove (23) here has a rectangular cross section. It is intended to make it easier to install and hold the bullet in the cartridge.

According to a conventional technique, the body (2) of the bullet may comprise decompression grooves.

Figure 7:
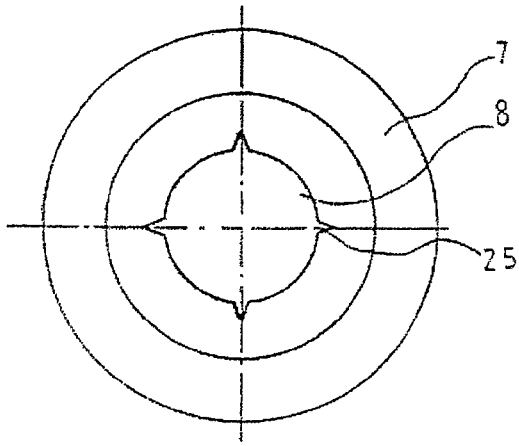
FIG. 7: a front view of the nose of the ogive comprising the fragmentation notches of the wall.

As shown in FIG. 7, the orifice (8) may have fragmentation notches (25) which make it easier to partially open the ogival nose (7) thus accelerating the deformation of the head of the bullet on impact with the target.

The invention claimed is:

1. A bullet for a small, medium or large caliber gun, with the caliber of the bullet of the type comprising an internal shaft with a rigidity greater than that of the body of the bullet, disposed in a blind hole drilled in the body of the bullet along its axis and which opens on the front ogival head of the bullet, characterized in that the internal shaft is set back from the orifice of the hole, and wherein the orifice of the hole situated on the axis has a smaller diameter than that of the internal shaft, and the wall of the ogival head of the bullet body comprises one or more deformation notches close to the orifice of the hole, the one or more deformation notches made by a narrowing of the ogival head, which comprises a nose and a rear portion, separated by the one or more deformation notches, and a cavity of conical or cylindro-conical shape, with the cavity having a large base, which is delimited by the front face of the internal shaft, and with a diameter of the cavity being larger than the diameter of the hole encompassing the shaft, and with the ogival rear portion smoothly narrowing to the base of the nose of the ogive, with the base widening to a cross-section slightly larger than the top of the rear portion.

2. The bullet as claimed in claim 1, wherein the narrowing is situated at the base of the conical or cylindro-conical internal cavity formed in front of the internal shaft or slightly in front of this base.

3. The bullet as claimed in claim 2, wherein the narrowing made in the wall of the ogive forms a deformation notch between the large base of the ogival nose and the front end of the rear portion of the ogive, the height of the deformation notch lying between 0.05 and 1 mm.

4. The bullet as claimed in claim 1, wherein the internal cavity is cylindro-conical in shape and the narrowing is situated at the line where the conical and cylindrical surfaces meet.

5. The bullet as claimed in claim 4, wherein the narrowing made in the wall of the ogive forms a deformation notch between the large base of the ogival nose and the front end of the rear portion of the ogive, the height of the deformation notch lying between 0.05 and 1 mm.

6. The bullet as claimed in claim 1, wherein the narrowing made in the wall of the ogive forms a deformation notch between the large base of the ogival nose and the front end of the rear portion of the ogive, the height of the deformation notch lying between 0.05 and 1 mm.

7. The bullet as claimed in claim 1, wherein the ratio of the diameter $d_1$ of the orifice to the diameter d of the internal shaft lies between 0.1:1 and 0.9:1.

8. The bullet as claimed in claim 1, wherein the nose of the ogive comprises a flat nose whose external diameter $d_2$ is such that the ratio of the external diameter of the flat nose to the diameter d of the internal shaft $d_2/d$ lies between 0.3:1 and 1.5:1.

9. The bullet as claimed in claim 8, wherein the ratio $d_2/d$ lies between 0.6:1 and 1:1, while the diameter $d_1$ of the orifice is such that the ratio of the diameter of the orifice to the diameter $d_1$ of the internal shaft $d_1/d$ lies between 0.3:1 and 0.6:1.

10. The bullet as claimed in claim 1, wherein the narrowing is situated at the base of the conical or cylindro-conical internal cavity formed in front of the internal shaft or slightly in front of this base.

11. The bullet as claimed in claim 1, wherein the internal cavity is cylindro-conical in shape and the narrowing is situated at the line where the conical and cylindrical surfaces meet.

12. The bullet as claimed in claim 1, wherein the narrowing made in the wall of the ogive forms a deformation notch between the large base of the ogival nose and the front end of the rear portion of the ogive, the height of the deformation notch lying between 0.05 and 1 mm.

13. The bullet as claimed in claim 1, wherein the nose of the ogive comprises a flat nose whose external diameter $d_2$ is such that the ratio of the external diameter of the flat nose to the diameter d of the internal shaft $d_2/d$ lies between 0.3:1 and 1.5:1.

14. The bullet as claimed in claim 1, wherein the nose of the ogive comprises a flat nose whose external diameter $d_2$ is such that the ratio of the external diameter of the flat nose to the diameter d of the internal shaft $d_2/d$ lies between 0.3:1 and 1.5:1.

15. The bullet as claimed in claim 1, wherein the nose of the ogive comprises a flat nose whose external diameter $d_2$ is such that the ratio of the external diameter of the flat nose to the diameter d of the internal shaft $d_2/d$ lies between 0.3:1 and 1.5:1.

* * * * *